United States Patent [19]

Torii

[11] 4,355,666

[45] Oct. 26, 1982

[54] SHUTTLE PROPELLING MECHANISM IN CIRCULAR LOOM

[75] Inventor: Soichi Torii, Kyoto, Japan

[73] Assignee: Torii Winding Machine Co., Ltd., Kyoto, Japan

[21] Appl. No.: 196,915

[22] PCT Filed: May 29, 1979

[86] PCT No.: PCT/JP79/00138

§ 371 Date: Jul. 23, 1980

§ 102(e) Date: Jul. 23, 1980

[87] PCT Pub. No.: WO80/01173

PCT Pub. Date: Jun. 12, 1980

[30] Foreign Application Priority Data

Nov. 29, 1978 [JP] Japan ..... 53-148529

[51] Int. Cl.[3] ..... D03D 37/00

[52] U.S. Cl. ..... 139/13 R

[58] Field of Search ..... 139/13 R, 13 A, 14, 139/16, 436

[56] References Cited

U.S. PATENT DOCUMENTS

| | | | |
|---|---|---|---|
| 2,601,358 | 6/1952 | Ancet | 139/13 R |
| 2,619,988 | 12/1952 | Pelce | 139/13 A |
| 2,714,396 | 8/1955 | Casati et al. | 139/13 R |
| 2,813,547 | 11/1957 | Rabeux et al. | 139/13 R |
| 3,871,413 | 3/1975 | Torii | 139/13 R |

FOREIGN PATENT DOCUMENTS

| | | | |
|---|---|---|---|
| 557945 | 9/1932 | Fed. Rep. of Germany | 139/13 R |
| 2-72785 | 2/1927 | Japan . | |

*Primary Examiner*—Henry Jaudon

*Attorney, Agent, or Firm*—Burgess, Ryan and Wayne

[57] ABSTRACT

In a circular loom in which at least one shuttle is continuously travelled in one direction along an annular shuttle guide means, and a plurality of shed forming mechanisms arranged annularly and coaxially with the guide means are sequentially opened prior to arrival of the shuttle to form a moving shed through which the shuttle is to be inserted and passed, each of the shed forming mechanisms having a cylindrical cam mechanism which creates an opening movement of the respective healds, a shuttle propelling mechanism is disposed. This shuttle propelling mechanism comprises a supporting plate rotatably mounted on an extension of a rotation shaft of the cylindrical cam mechanism at a position corresponding to the annular shuttle guide means, at least one horizontal shaft fixed to this supporting plate correspondingly to the shuttle, a shuttle engaging mechanism mounted on the free end of the horizontal shaft, which engaging mechanism is to be engaged with a part of the shuttle guided by the annular shuttle guide means, and a mechanism for transmitting the rotational movement of the cylindrical cam mechanism to the horizontal shaft.

5 Claims, 13 Drawing Figures

SHUTTLE PROPELLING MECHANISM IN CIRCULAR LOOM

DESCRIPTION

TECHNICAL FIELD

This invention relates to a shuttle propelling mechanism in a circular loom.

BACKGROUND ART

Bags formed from woven fabrics of a plain weave structure utilizing tapes of synthetic resins, such as polypropylene and polyethylene resins or synthetic resin strands, such as multifilament yarns or cords of synthetic resins, as warps and wefts have been widely used for transportation and storage of granules, such as grains, sugar fertilizers and synthetic resin pelletes. This is because these bags are strong and light in weight. These bags can be made from a tubular fabric produced by using an ordinary power loom, but there is a tendency to use circular looms having a high weaving efficiency for the manufacture of the tubular fabric to be formed into these bags. Therefore, there have been various attempts to use of circular looms in not only Japan but also other industrially advanced countries. As a typical instance of a tubular-fabric practical circular loom, there can be mentioned the circular loom disclosed in U.S. Pat. No. 3,871,413, or a circular loom which has been manufactured and sold by the British Company, Fairbairn Lawson Machinery, Ltd.

As is well known, in a circular loom of the above-mentioned type, an even number of shuttles are mounted on an annular shuttle guide member so that they can travel along this guide member, and engaging means to be engaged with corresponding shuttles, respectively, such as press rollers, are moved along the shuttle guide member. Each shuttle is pressed by the corresponding engaging means and is propelled along the shuttle guide member. Wefts taken out from the respective shuttles are fabricated with warps sequentially opened on both the upper and lower sides of the respective shuttles by healds, and a tubular fabric is thus formed.

However, if waste yarns are mingled in the warps or some of the warps are split in the lengthwise direction, the warps are often entangled with each other so that they can not be normally opened. In the conventional circular loom, a shuttle propelling engaging means, such as a press roll, is directly connected to a rotary member rotating in the shuttle propelling direction around the central axis of a shuttle guide member, for example, a cam drum wheel having a cam rail mounted on the peripheral face thereof to operate healds. Accordingly, when the warps are not opened for the above-mentioned reasons, the shuttles are pushed under a high pressure into the warps which are not opened but kept in closed condition. Accordingly, in this case, there are caused various troubles such as breakage of warps and damage to the shuttle propelling engaging means and a supporting mechanism therefor.

DISCLOSURE OF INVENTION

It is a primary object of the present invention to provide a shuttle propelling mechanism in a circular loom, in which the above-mentioned defects of the conventional circular loom can be eliminated, and when warps are not normally opened by entanglement or the like, breakages of warps or damage to the shuttle propelling engaging means or a supporting mechanism therefor by the pressing force of the shuttles can be prevented.

In accordance with the present invention, this object can be attained by a shuttle propelling mechanism in a circular loom, which is characterized in that a shuttle propelling engaging means is supported on a supporting member rotatably pivoted around the central axis of a shuttle guide member and the rotation of the supporting member is restrained by rotation restraining means urged by urging means, such as a spring, toward the rotation direction of rotary member rotating around the central axis of the shuttle guide member in the shuttle propelling direction, such as a cam drum wheel. This rotation restraining means is arranged so that when an excessive load is imposed on a support in the rotation direction thereof, the rotation restraining means is displaced by the urging means, such as a spring, to release the restraint on the support and rotary member with respect to the rotation direction. The shuttle propelling engaging means has an over-running preventing function of preventing excessive running of the shuttles, that is, a function of preventing the shuttles from over-running from the shuttle propelling engaging means.

Accordingly, when the shuttle propelling mechanism of the present invention is adopted, even if abnormal sheds are formed, forcible insertion of shuttles into the sheds is prevented and the restraint of the supporting member of the shuttle propelling mechanism and the rotary member for driving the supporting member is released, whereby occurrence of the above-mentioned troubles can be completely prevented.

BEST MODE FOR CARRYING OUT INVENTION

For the purpose of clearly illustrating the shuttle propelling mechanism of the present invention, an embodiment of a circular loom to which the mechanism of the present invention is applied will be described, with reference to FIGS. 1 through 5, prior to entering into the description of the structure and effect of the shuttle propelling mechanism of the present invention.

Figure 1:
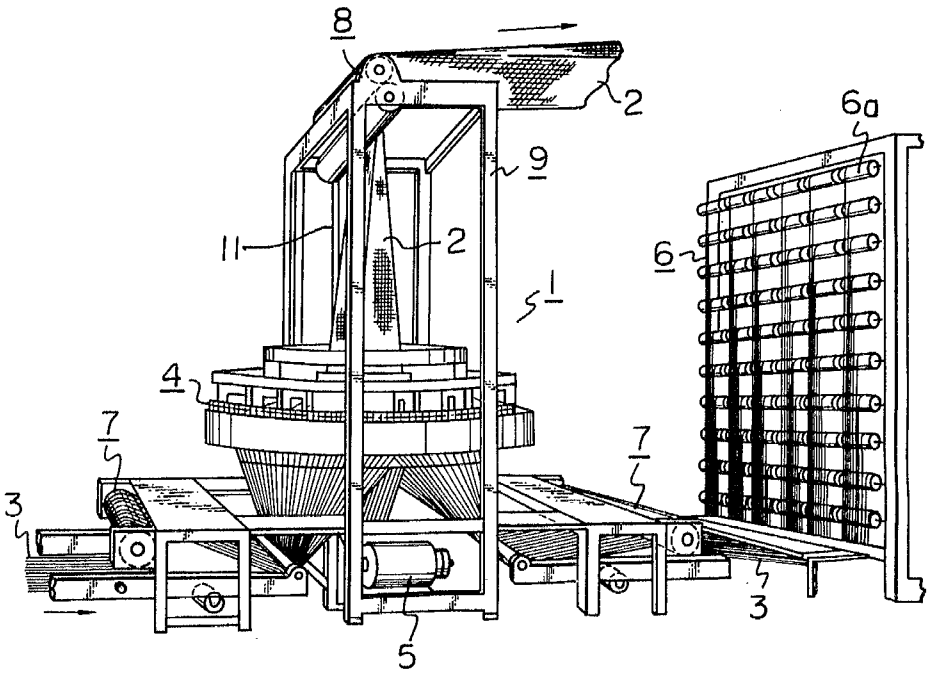
FIG. 1 is a perspective view illustrating one embodiment of a circular loom in which the shuttle propelling mechanism of the present invention is utilized.

In the circular loom 1 illustrated in FIG. 1, a main part 4 including shed forming means and filling means is mounted within a frame 9, and the shed forming means and filling means are driven by an electric motor 5 disposed below the main part 4 through a first power transmission mechanism (not shown). Tubular fabric take-out means 8 mounted on the frame 9 above the main part 4 is driven by a second transmission mechanism (not shown) connected to the take-out means 8. Since this second power transmission mechanism is driven by the first transmission mechanism through a driving transmission lever 11, the take-out means 8 is driven while being kept synchronous with the main part 4. Warps 3, in a number necessary for weaving a desirable tubular fabric 2, are fed to a pair of creels 6 disposed on both the sides of the main part 4 symmetrically with each other with respect to the main part 4 (only one creel disposed on the right side is illustrated in FIG. 1), from a plurality of packages 6*a* mounted rotatably for feeding warps, and the warps 3 are fed to the main part 4 through warp feed-out means 7. The tubular fabric 2 formed by the weaving operation in the main part 4 of the circular loom 1 is upwardly taken out by the take-out means 8 and guided to winding means (not shown) in a direction indicated by an arrow.

Figure 2:
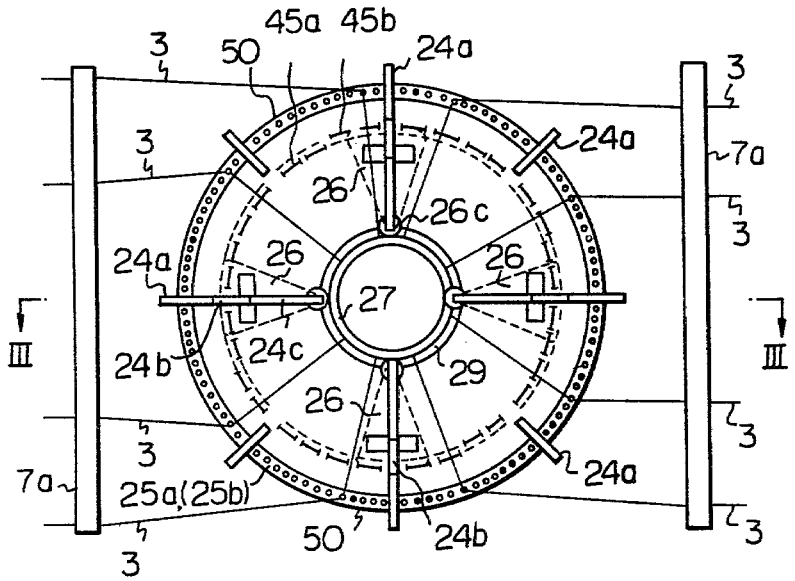
FIG. 2 is a partially omitted plan view illustrating a main part of the circular loom illustrated in FIG. 1.
Figure 3:
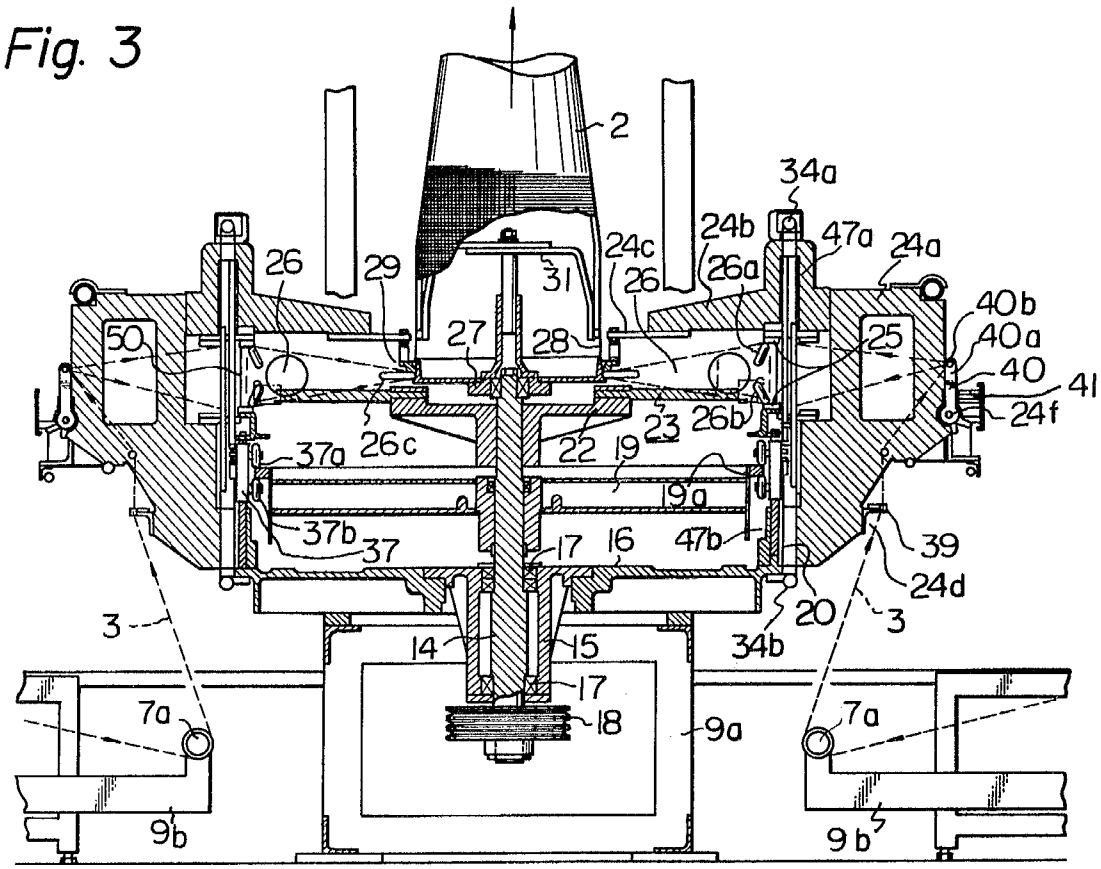
FIG. 3 is a side view illustrating the section taken along line III—III in FIG. 2, which illustrates the main part of the circular loom illustrated in FIG. 1.

As shown in FIGS. 2 and 3, the main part 4 of the circular loom 1 comprises a vertical shaft 14 rotatably supported through a pair of roll bearings 17 on bearings housing 15 fixed to a central opening of a disc-like frame 16 fixed to a base 9*a* of the frame 9; a grooved pulley 18 fixed to the lower end of the vertical shaft 14, a cylindrical cam mechanism 19 fixed to the shaft 14 at a position above the disc-like frame 16, a shed forming mechanism, described hereinafter, which is operated by an annular cam 19*a* of the cylindrical cam mechanism 19, four shuttle propelling mechanisms 23 fixed to a supporting member 22 fixed to the shaft 14 above the cylindrical cam mechanism 19; an annular guide means 25 comprising a pair of annular guide members 25*a*, 25*b* for guiding two pairs of front and rear wheels 26*a* and 26*b* mounted on both the sides of a shuttle 26; a horizontal disc guide member 27 supported rotatably on the top of the shaft 14 to guide another wheel 26*c* of the shuttle 26; an annular guide 29 which is stationarily held through an intermediate member 28 by supporting arms 24*c*, with a slight clearance from the top end of the annular edge of the horizontal disc guide member 27, so as to guide the tubular fabric 2; eight frame members 24*a* fixed to the disc-like frame 16; arms 24*b* fixed to every other one of the frame members 24*a*; a plurality of yarn guides 39 mounted on an annular member 24*d* fixed to the frame members 24*a*; a plurality of warp tension regulating dancing levers 40 pivoted to another annular member 24*f* having a circular section similarly fixed to the frames 24*a*, and control means which is capable of actuating when the dancing lever 40 turns over a predetermined turning angle. The supporting arms 24*c* are fixedly held by the arms 24*b* as illustrated in FIGS. 2 and 3. As shown in the drawings (FIGS. 1 and 3), warps 3 are guided from the creels 6 through guide rolls 7*a* rotatably supported on frames 9*b* and the yarn guides 39 to yarn guide apertures 40*b* formed on the top end portion 40*a* of the dancing lever 40, and a shed is formed by the shed forming mechanism, the structure of which is illustrated in detail in FIG. 4. The shuttle 26 propelled by the shuttle propelling mechanism 23 is inserted in this shed to weave the tubular fabric 2, and the tubular fabric 2 is taken out upwardly (in a direction indicated by an arrow) through an annular clearance formed between the circular edge of the horizontal guide member 27 and the annular guide 29, while being guided by a fabric guide member 31. Then, the tubular fabric 2 is wound on a roll through the take-out means 8 (FIG. 1) by winding means (not shown).

Figure 4:
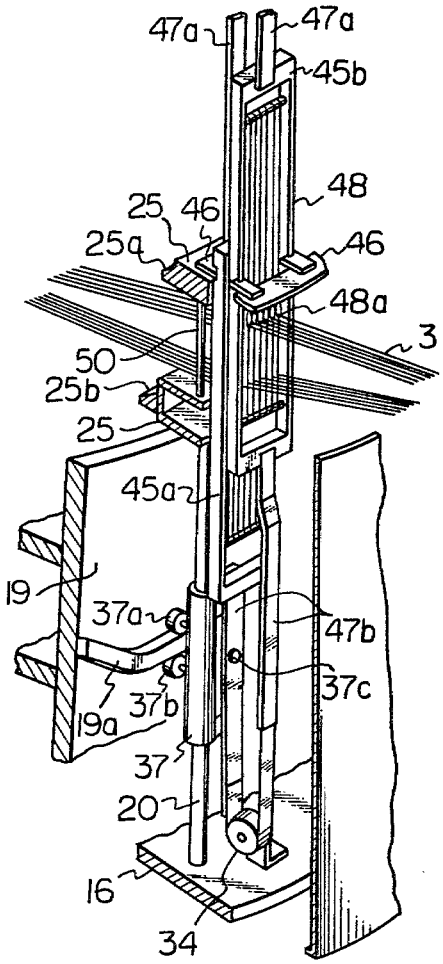
FIG. 4 is a perspective view of a shed forming mechanism of the circular loom illustrated in FIG. 1.

In the circular loom 1 having the above-mentioned structure, as shown in FIG. 4, the shed forming mechanism comprises: a plurality of vertical guide rods 20 fixed to the peripheral flange portion of the disc-like frame 16; a cam-follower holding member 37 slidably mounted on the respective guide rods 20; a cam 19*a* projected from the periphery of the cylindrical cam mechanism 19; a pair of cam-followers 37*a* and 37*b*, which are rotatably mounted on the holding member 37 so that they have rolling contact with the cam 19*a* from above and below the cam 19*a*, respectively; heald frame guides 46 mounted on the upper annular guide member 25*a* to guide a pair of heald frames 45*a* and 45*b* (heald frame guides are similarly mounted on the lower annular guide member 25*b*, but they are omitted in FIG. 4); belts 47*a* and 47*b* for connecting both the heald frames 45*a* and 45*b* to move the heald frames 45*a* and 45*b* vertically in opposite directions and, thus, form a fully open shed; and a belt guide 34*b* mounted on the peripheral flange portion of the disc-like cam 16. Since the holding member 37 to which the cam-followers 37*a* and 37*b* are attached is connected to the belt 47*b* by a pin member 37*c*, a vertical movement is given to the heald frame 45*a* by the vertical movement of the holding member 37. This vertical movement is transmitted to the other heald frame 45*b* through the belts 47*a* and 47*b*. Accordingly, a vertical movement reversed to the vertical movement of the heald frame 45*a* is given to the heald frame 45*b*. The same number of heald wires 48 are held by each of the heald frames 45*a* and 45*b*, and vertical rods 50 in a number corresponding to the number of the heald wires 48 are fixedly arranged lengthwise in a space between the confronting horizontal planes of the upper and lower guide members 25*a* and 25*b* of the annular guide means 25. Since the shape of the cam face of the projection cam 19*a* is designed with respect to the heald frames 45*a* and 45*b* so that a fully open shed is formed when the warps 3 are passed through the eyes 48*a* of the corresponding heald wires 48, respectively, a shed forming a plain weave structure can be produced by rotation of the cylindrical cam mechanism 19. Since plural pairs of the above-mentioned paired heald frames 45*a* and 45*b* are annularly arranged along the periphery of the cylindrical cam mechanism 19 adjacently to one another, these paired heald frames 45*a* and 45*b* are capable of creating successive sheds of identical shape with rotation of the cylindrical cam mechanism 19. Accordingly, if a plurality of shuttles 26, for example, four shuttles 26 are propelled by the respective shuttle propelling mechanisms 23 held by the supporting member 22, synchronously with formation of these sheds, a tubular fabric 2 of a plain weave structure can be formed.

The structures, functions and effects of the shuttle propelling mechanism of the present invention applied to a circular loom having the above-mentioned structure and the shuttled to be used in the present invention will now be described in detail.

Figure 5:
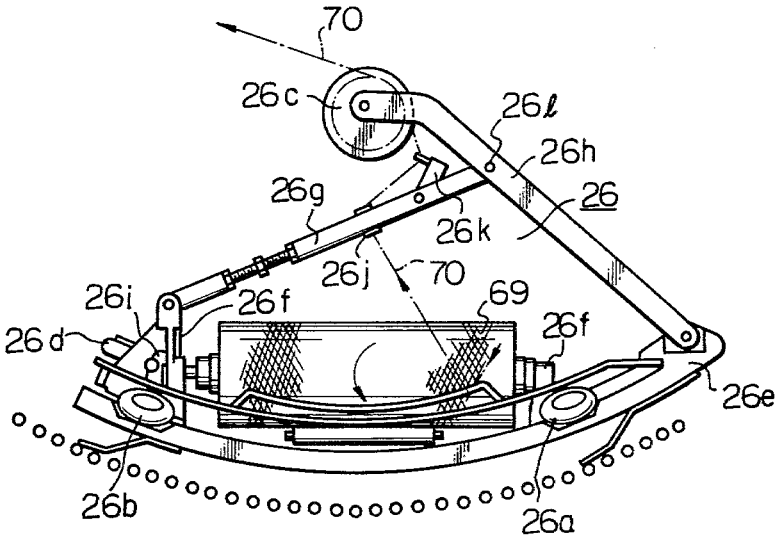
FIG. 5 is a side view of a shuttle to be used for the circular loom illustrated in FIG. 1.

As will be apparent from the above-mentioned illustration referring FIGS. 2, 3 and 4, the shuttle 26 is supported so that it can travel between the paired upper and lower guide members 25*a*, and 25*b* of the annular guide means 25 and the disk-like guide member 27 disposed inside coaxially therewith through wheels 26*a*, 26*b* and 26*c*. In the present embodiment, four shuttles 26 are utilized, and a roller 26*d* capable of having rolling contact with the propelling member of the shuttle propelling mechanism 23 is rotatably mounted on the rear end portion of a frame 26*e* of each shuttle 26 as shown in FIG. 5. A pair of brackets 26*f* are mounted on the frame 26*e* to hold a weft bobbin 69 rotatably around the axis thereof. In order to mount or dismount the weft bobbin 69, one bracket 26*f* is pivoted on a supporting member 26*i* projected from the frame 26*e*. The above-mentioned wheel 26*c* is rotatably mounted on the top end portion of a lever 26*h* pivoted on the top end portion of the frame 26*e*. An endless groove is formed on the periphery of the wheel 26*c* to guide a weft 70 which is taken from the weft bobbin 69. The lever 26*h* is turnably connected to the top end of a connecting member 26*g* by means of a pin 26*l*. The yarn 70 on the weft bobbin 69 held on the bracket 26*f* of the shuttle 26 is introduced to the guide groove of the wheel 26*c* through yarn guides 26*j* and 26*k* mounted on the connecting member 26*g* and is taken out from the bobbin 69 with the movement of the shuttle 26.

As shown in FIGS. 6 through 9, the shuttle propelling mechanism 23 comprises: a supporting member 22 disposed rotatably on the vertical shaft 14 of the annular guide means 25; four horizontal shafts 23*a* fixed to four corresponding brackets 22*a* formed on the peripheral edge of the supporting member 22 symmetrically with respect to the vertical shaft 14; a roller 23*g* rotatably supported on a lever 23*c* held by each shaft 23*a* to roll on the guide member 25*b* of the annular guide member 25, and; a push roller 23*b* rotatably held on the top end of each horizontal shaft 23*a*. This push roller 23*b* is arranged at a position where it is allowed to fall in rolling contact with the roller 26*d* of the shuttle 26 from behind the roller 26*d*. A stop roller 23*d* is rotatably supported by the lever 23*c* swingably supported on the top end portion of the horizontal shaft 23*a*, and this stop roller 23*d* is located forwardly of the roller 26*d* of the shuttle 26, with which the push roller 23*b* falls in contact, with respect to the moving direction of the shuttle 26. This lever 23*c* is held at a position where the roller 23*g* rolls on the annular guide member 25*b*, by a spring 23*f* connected to an arm 23*i* projected from a block 23*e* (see FIG. 9) having one end fixed to the shaft 23*a*.

As pointed out hereinbefore, the heald frames 45*a* and 45*b* are operated by the annular cam 19*a* formed on the peripheral face of the cylindrical cam mechanism 19. The cylindrical cam mechanism 19 is pivoted, on the lower portion of the supporting member 22, rotatably around the central shaft 14, and it is rotated in a direction indicated by arrow X, that is, the movement direction of the shuttle, by a driving mechanism such as a motor.

The shuttle propelling mechanism 23 of the present invention having the above-mentioned structure is driven by the movement of the cylindrical cam mechanism 19 as the drive source.

Figure 6:
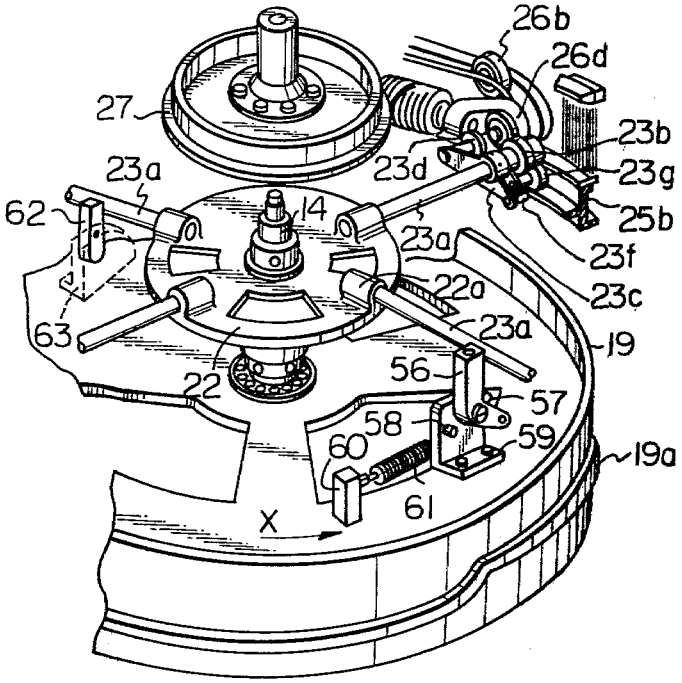
FIG. 6 is a perspective view of the shuttle propelling mechanism of the present invention, which is utilized for the circular loom illustrated in FIG. 1.
Figure 7:
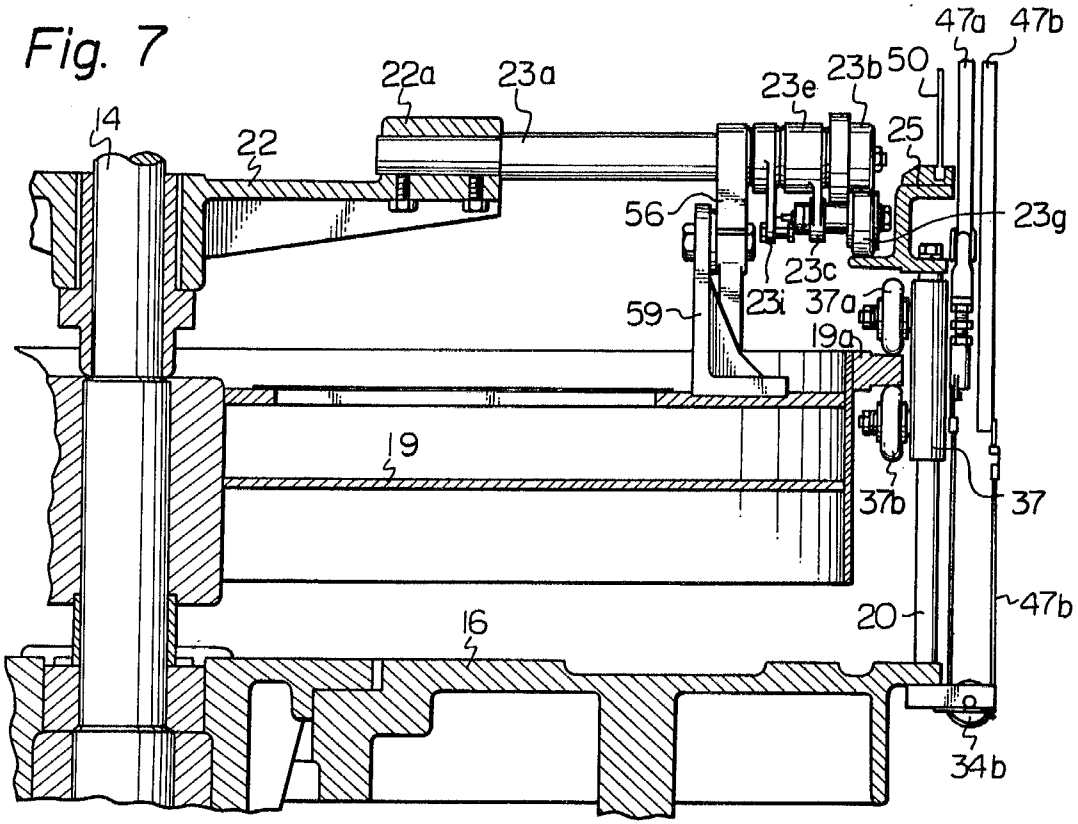
FIG. 7 is a partially sectional side of one unit of the shuttle propelling mechanism illustrated in FIG. 6.
Figure 8:
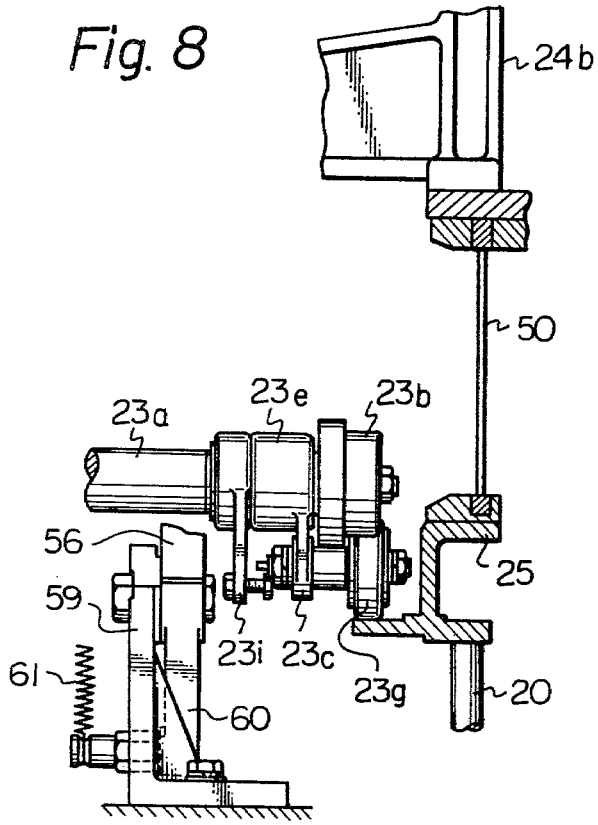
FIG. 8 is a side view of a main part of the shuttle propelling mechanism illustrated in FIG. 7.
Figure 9:
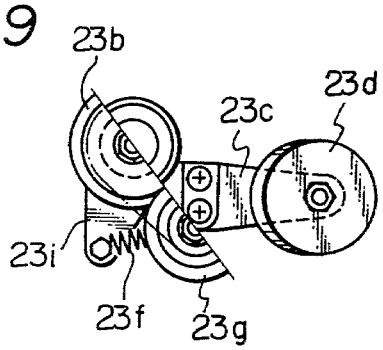
FIG. 9 is a diagrammatical representation illustrating the relative positional relationship of members of the shuttle propelling mechanism illustrated in FIG. 8, seen from the direction of the horizontal axis thereof.
Figure 10:
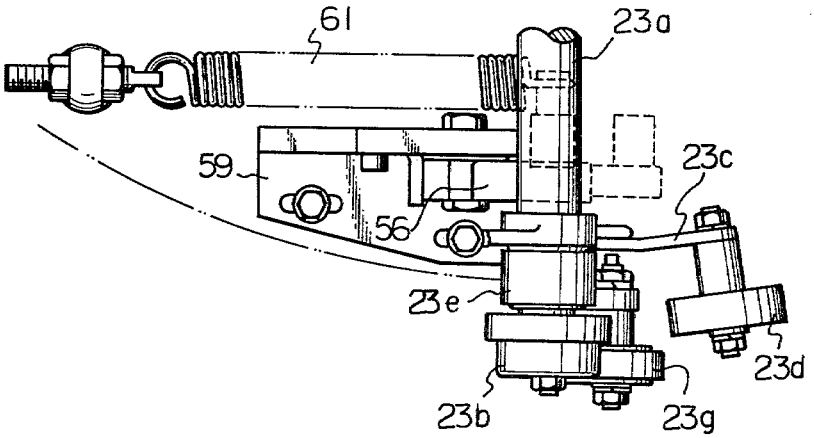
FIG. 10 is a partially omitted plan view illustrating a mechanism for transmitting the rotational movement of the cylindrical cam mechanism illustrated in FIG. 7 to the horizontal shaft of the shuttle propelling mechanism.
Figure 11:
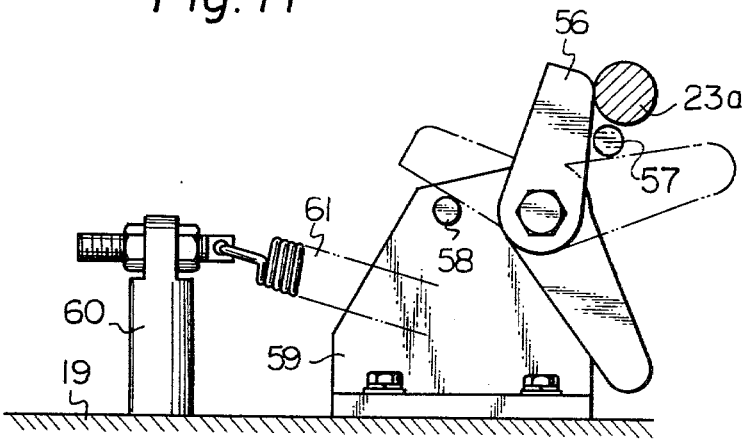
FIG. 11 is a side view of a part of the transmission mechanism illustrated in FIG. 10.

As shown in FIGS. 6, 10 and 11, the supporting member 22 and respective shafts 23*a* are restrained the motion thereof to the rotation direction of the cylindrical cam mechanism 19 by a single push lever 56. This push lever 56 is swingably pivoted on a bracket 59 attached to the top face of the cylindrical cam mechanism 19 and is normally held in a vertical position by a spring 61 connected on one end thereof to the lever 56 with the other end thereof fixed to a bracket 60 mounted on the cam mechanism 19, and by a stopper 57 fixed to the bracket 59. The length of the push lever 56 is such that, when the push lever 56 is held in the vertical position, it can be engaged with the horizontal shaft 23*a* from behind the shaft 23*a*. The push lever 56 is allowed to swing against the spring 61 in the counterclockwise direction in FIGS. 6 and 11, that is, in the direction reverse to the rotation of the cylindrical cam mechanism 19, to the horizontal position. By this swinging movement, the engagement of the push lever 56 with the horizontal shaft 23*a* can be released. The dead point of the push lever 56 to the spring 61 is located between the vertical position and horizontal position thereof, and therefore, when the push lever 56 swings to the horizontal position, the spring 61 acts on the push lever 56 in the direction being reverse to the previous turning direction thereof and the push lever 56 is supported in the horizontal position by the spring 61 and the stopper 58 mounted on the bracket 59.

Figure 12:
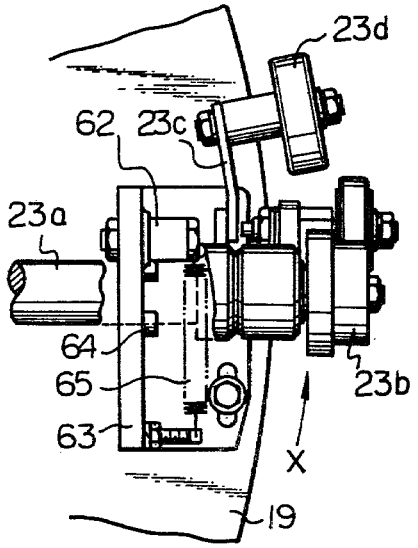
FIG. 12 is a plan view of a mechanism for preventing over-running of the horizontal shaft of the shuttle propelling mechanism illustrated in FIG. 7.
Figure 13:
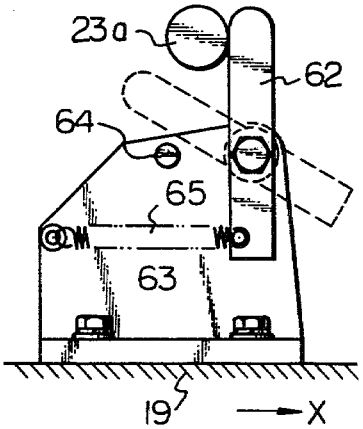
FIG. 13 is a side view of the over-running preventing mechanism illustrated in FIG. 12.

In this embodiment, another stop lever 62 is disposed at a position symmetrical with the position of the push lever 56 with respect to the vertical shaft 14, as shown in FIG. 6. As shown in FIGS. 6, 12 and 13, the stop lever 62 is swingably pivoted on a bracket 63 attached to the top face of the cylindrical cam mechanism 19 and is held in the vertical posture by a spring 65 having one end connected to the bracket 63 and the other end connected to the stop lever 62 and a stopper 64 fixed to the bracket 63. As shown in FIG. 6, the position of the stop lever 62 is arranged so that when the push lever 56 is engaged with the horizontal shaft 23*a* from behind the shaft 23*a*, the stop lever 62 is located forwardly of the horizontal shaft 23*a* located at the position symmetrical with the position of the horizontal shaft 23*a* and is engaged with the horizontal shaft 23*a*. The spring 65 is disposed only to support the stop lever 62 and its pulling force is small, and therefore, the stop lever 62 is allowed to swing under a small tension in the clockwise direction in FIG. 6, and the counterclockwise direction in FIG. 13, that is, in the direction opposite to the rotational direction of the cylindrical cam mechanism 19, against the pulling force of the spring 65.

In the circular loom having the above-mentioned structure, when the cylindrical cam mechanism 19 is rotated in the direction indicated by arrow X, the push lever 56 falls in engagement with the horizontal shaft 23*a*, from behind the shaft 23*a*, to urge the shaft 23*a*. Accordingly, the respective horizontal shafts 23*a* are rotated integrally with the supporting member 22 with rotation of the cylindrical cam mechanism 19. Each push roller 23*b* is moved along the annular guide means 25 with rotation of the horizontal shaft 23*a* to press the roller 26*d* of each shuttle 26 from behind the roller 26*d* and propel the shuttle 26. Accordingly, the respective shuttles 26 are moved at predetermined equal intervals along the annular guide means 25 and the peripheral guide portion of the inner guide member 27.

The stop roller 23*d* of each horizontal shaft 23*a* is located forwardly of the roller 26*d* of each shuttle 26 and is engaged therewith to prevent the shuttle 26 from running by the force of inertia irrespectively of the push roller 26*b*. The stop lever 62 is located forwardly of the horizontal shaft 23*a* and is engaged therewith to prevent the horizontal shaft 23*a* and supporting member 22 from axial displacement about the vertical shaft 14 by the force of inertia irrespectively of the push lever 56.

The respective heald frames 45*a* and 45*b* are operated by the action of the annular cam 19*a* of the cylindrical cam mechanism 19 and the cam followers 37*a*, 37*b* to form an open shed of the warps 3, so that warps 3 are positioned on both the upper and lower sides of the respective shuttles 26 in sequence. Accordingly, the warps 3 are woven with wefts 70 taken out from the shuttles 26 and a tubular fabric 2 is formed.

The force necessary for propelling the shuttles 26 is imposed on the push lever 56 of the cylindrical cam mechanism 19 through the horizontal shaft 23*a* as the load in the rotational direction of the supporting member 22 and this force is borne by the spring 61. When the warps 3 are not normally opened by entanglements caused by incorporation of waste yarns into the warps 3 or by lengthwise split of the warps, which is frequently caused when filmy yarn of a synthetic resin is employed, the shuttles 26 are pushed forward to the sheds which are not normally opened and contain closed warps and propelling of the shuttles 26 is inhibited by the such closed warps 3. Accordingly, in this case, a load larger than the pulling force of the spring 61 is imposed on the supporting member 22 in the rotational direction thereof, and the push lever 56 is forced to swing to the horizontal position against the pulling force of the spring 61 with rotation of the cylindrical cam mechanism 19, and the engagement between the horizontal shaft 23*a* and the push lever 23*a* is released.

In other words, when the load in the rotational direction of the supporting member 22 becomes larger than the pulling force of the spring 61, the restraint on the supporting member 22 and the cylindrical cam mechanism 19 in the rotational direction is released. Accordingly, the rotating torque of the cylindrical cam mechanism 19 is not transmitted to the supporting member 22, and even if the cylindrical cam mechanism 19 is continuously rotated, the supporting member 22 is not driven so that the shuttles 26 can not be propelled. The pressure imposed on each shuttle 26 when the restraint on the supporting member 22 and cylindrical cam mechanism 19 in the rotational direction is released is determined by the pulling force of the spring 61. Accordingly if the pulling force of the spring 61 is appropriately set in advance, it is possible to prevent breakages of the warps 3 or damage to the push roller 23*b* and horizontal shaft 23*a* by the pressing force of the shuttle 26 when the shuttle 26 is stuffed into the closed shed of warps 3.

The push lever 56 which has swung to the horizontal position posture is supported in this horizontal position by the spring 61 and stopper 58. Accordingly, even if the cylindrical cam mechanism 19 is further rotated in the direction of arrow X, the push lever 56 is not engaged with the subsequent horizontal shaft 23*a* located forwardly, but passes below this shaft 23*a* in this state. Accordingly, the pressing force is not applied to the shuttle 26. When only the cylindrical cam mechanism 19 is rotated, the stop lever 62 becomes engaged with the subsequent horizontal shaft 23*a* located forwardly. However, since the pulling force of the spring 65 connected to the stop lever 62 is small, the stop lever 62 is allowed to swing under a low pressure with rotation of the cylindrical cam mechanism 19 on engagement with the horizontal shaft 23*a*, and the stop lever 62 passes below the horizontal shaft 23*a*. Accordingly, the shuttle 26 is not influenced.

As will be apparent from the above-mentioned illustration, in the present invention, since the supporting member supporting the shuttle propelling engaging means and the rotary member, such as the cylindrical cam mechanism, are restrained with respect to the rotational direction through urging means, such as a spring, the above-mentioned disadvantages involved in the conventional techniques, such as breakages of warps and damage to the shuttle propelling engaging means, and the like, by the pressing force of the shuttles, can be eliminated when the warps are not normally opened, that is, when normal sheds are not formed. Thus, the above-mentioned intended object of the present invention can be effectively attained.

The shuttle propelling mechanism of the present invention is not limited to the above-mentioned embodiment with respect to the structures of the shed forming mechanism, the shuttle and the like. Of course, the present invention can be applied to any circular loom in which shuttles travelling along an annular guide member are used. Accordingly, in a circular loom where one or more shuttles are used, if the shuttle propelling mechanism of the present invention is used for each shuttle, the filling operation can be performed satisfactorily in the moving shed of the circular loom.

I claim:

1. In a circular loom comprising an annular guide means for guiding at least one shuttle in a predetermined direction, a warp guide annular member disposed above said annular guide means coaxially therewith and having a plurality of warp guide slits, a plurality of shed forming mechanisms arranged annularly outside said warp guide annular member, a cylindrical cam mechanism mounted coaxially with said shuttle guide means, means for operating said shed forming mechanisms prior to arrival of the shuttle to form moving sheds, in a condition of successively forming sheds along said annular guide means, a mechanism for taking out a woven fabric along the axis of said shuttle guide means and driving means for rotating the cylindrical cam mechanism around the axis thereof in the direction of guiding the shuttle by the shuttle guide means, a shuttle propelling mechanism comprising a horizontal supporting member mounted rotatably at a position above said cylindrical cam mechanism on an upward extension of the rotation shaft of the cylindrical cam mechanism, at least one horizontal shaft corresponding to the shuttle to be used, said horizontal shaft being fixed to said supporting member and being extended to a position adjacent to said shuttle guide means, a shuttle engaging mechanism mounted on a free end portion of said horizontal shaft and means for transmitting the rotation of the cylindrical cam mechanism to any of said horizontal shafts.

2. A shuttle propelling mechanism according to claim 1, wherein the shuttle engaging mechanism includes a first roll rotatably mounted on a free end portion of said horizontal shaft and when said horizontal shaft is rotated with said cylindrical cam mechanism, said first roll presses a part of the corresponding shuttle to propel said shuttle.

3. A shuttle propelling mechanism according to claim 1, wherein the shuttle engaging mechanism includes a bracket mounted rotatably on a free end portion of said horizontal shaft, and second and third rolls rotatably supported on said bracket, the second roll has rolling contact with the shuttle guide means, and the third roll is located at a position such that it can be engaged with the corresponding shuttle forwardly of the position of the engagement of the first roll with the shuttle with respect to the shuttle propelling direction, thereby to exert the function of preventing over-running of the shuttle.

4. A shuttle propelling mechanism according to claim 1, wherein said means for transmitting the rotation of the cylindrical cam mechanism to the horizontal shaft comprises a bracket disposed in a horizontal plane intersecting at a right angle the rotational shaft of the cylindrical cam mechanism, a push lever mounted rotatably on said bracket, a free end portion of said push lever having a length sufficient for engagement with said horizontal shaft, a stopper for positioning said push lever so that the push lever can be engaged with said horizontal shaft and an elastic member causing said push lever to fall in contact with said stopper, and wherein when the cylindrical cam mechanism is rotated, said push lever becomes engaged with said horizontal shaft to press the horizontal shaft and rotate said horizontal supporting member coaxially with the cylindrical cam mechanism to propel said shuttle, and when an excessive load is imposed on said horizontal shaft with respect to the rotating movement thereof and becomes larger than the repulsive force of said elastic member, said push lever is turned to release the engagement between the push lever and the horizontal shaft.

5. A shuttle propelling mechanism according to claim 4, wherein said means for transmitting the rotation of the cylindrical cam mechanism to said horizontal shaft further comprises a stopper which is disposed on said horizontal plane of the cylindrical cam mechanism so that when the cylindrical cam mechanism is rotated in over-running condition and the push lever becomes engaged with any of the horizontal shafts, said horizontal shaft is prevented from over-running by said stopper.

* * * * *